United States Patent [19]

Ayers

[11] Patent Number: 4,843,793

[45] Date of Patent: Jul. 4, 1989

[54] MOBILE HOME SKIRTING SYSTEM

[75] Inventor: Randall W. Ayers, Kansas City, Mo.

[73] Assignee: Variform, Inc., Kearney, Mo.

[21] Appl. No.: 172,984

[22] Filed: Mar. 21, 1988

Related U.S. Application Data

[63] Continuation of Ser. No. 3,640, Jan. 15, 1987, abandoned.

[51] Int. Cl.[4] ..... E04D 1/00

[52] U.S. Cl. ..... 52/169.12; 52/530; 52/DIG. 3

[58] Field of Search ..... 52/169.12, 169.9, 299, 52/529, 530, 586, 588, DIG. 3

[56] References Cited

U.S. PATENT DOCUMENTS

| | | | |
|---|---|---|---|
| 512,188 | 1/1894 | Goodrich | 52/531 |
| 3,216,741 | 11/1965 | Newlin et al. | 52/530 X |
| 3,834,109 | 9/1974 | Iacona | 52/DIG. 3 |
| 4,043,088 | 8/1977 | Payton | 52/169.12 |
| 4,352,261 | 10/1982 | Wargo | 52/169.12 |
| 4,400,919 | 8/1983 | Szabo et al. | 52/169.12 |
| 4,549,378 | 10/1985 | Ayers et al. | 52/169.12 |

FOREIGN PATENT DOCUMENTS

| | | | |
|---|---|---|---|
| 4055 | 5/1901 | Austria | 52/530 |

*Primary Examiner*—David A. Scherbel
*Assistant Examiner*—Richard E. Chilcot, Jr.
*Attorney, Agent, or Firm*—Hovey, Williams, Timmons & Collins

[57] ABSTRACT

A continuous skirt to surround and close the space beneath an elevated building or as a barrier surrounding the insulated foundation of a building is provided with a series of releasably interconnected panels wherein the interlocks therebetween include reverse bends and a corrugation. The interlocks are hidden to provide a rigid connection to resist separation of the panels which connection is aesthetically pleasing when viewed from either side. By providing different colors on each side of each of the panels, the skirting is reversible, thereby reducing dealer inventory.

4 Claims, 1 Drawing Sheet

Fig. 2
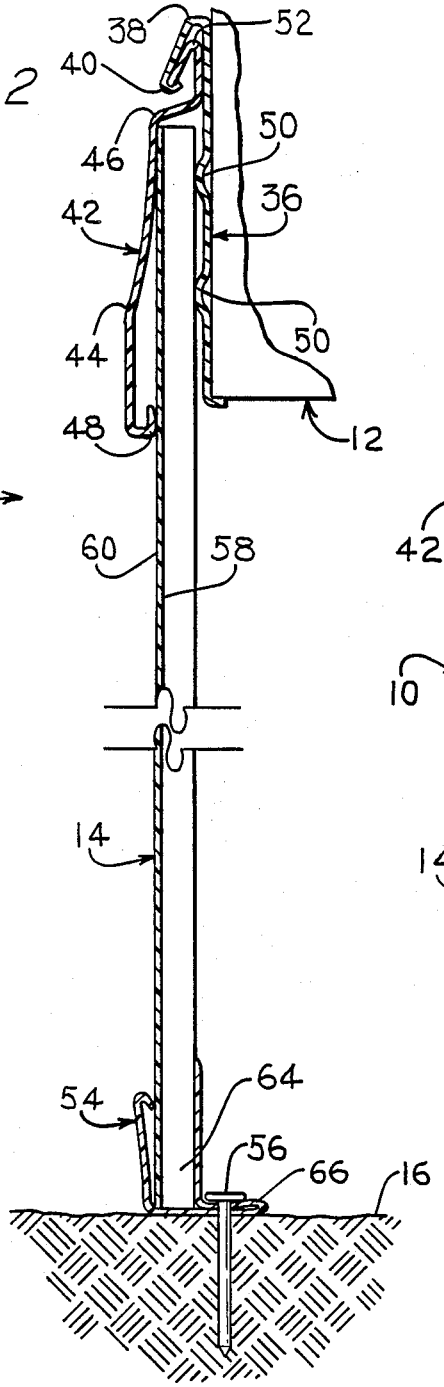
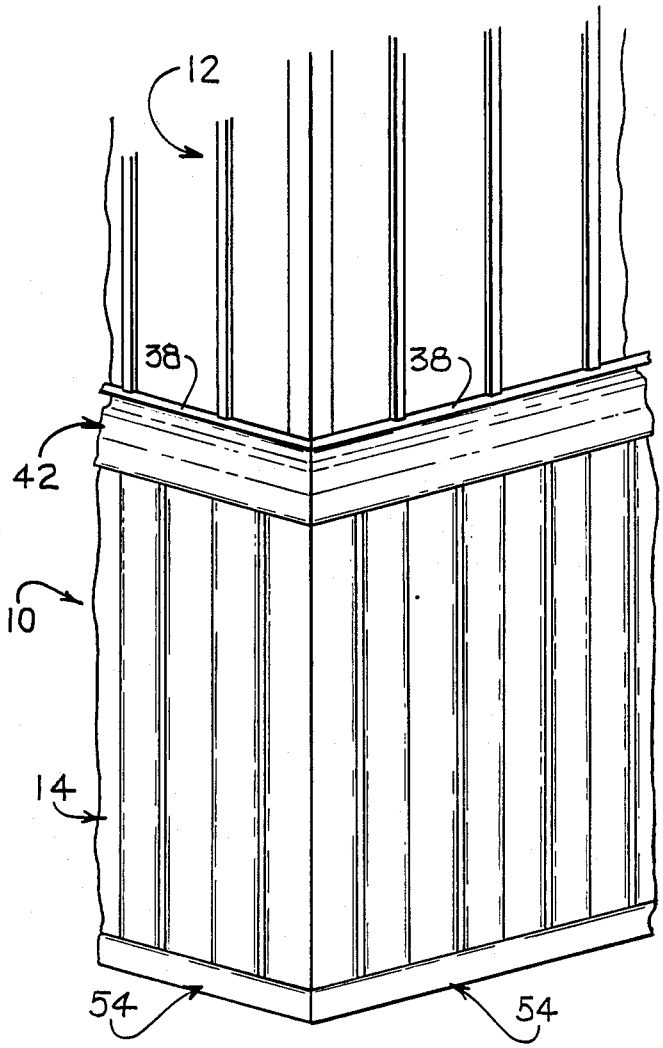
Fig. 1
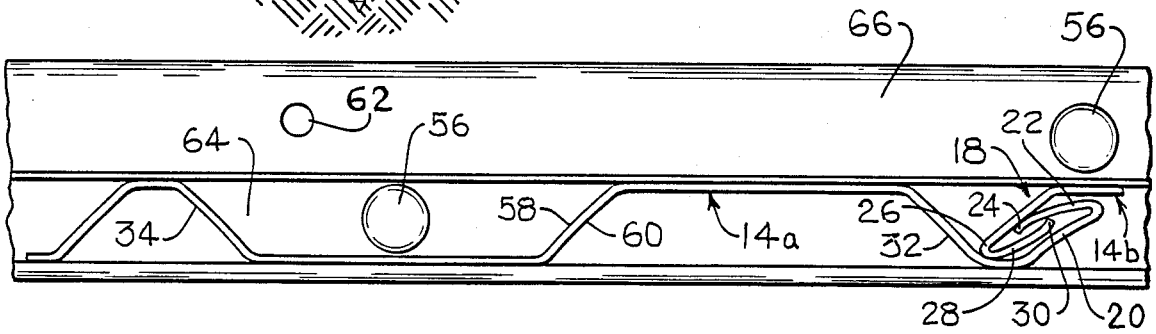
Fig. 3

MOBILE HOME SKIRTING SYSTEM

This application is a continuation of application Ser. No. 07/003,640, filed Jan. 15, 1987, now abandoned.

BACKGROUND OF THE INVENTION

1. Field of the Invention

Skirting systems for elevated buildings are well known for their advantages in enclosing the space beneath a building such as a mobile home. Moreover, it is common to employ a series of lightweight, flexible plastic panels which are interlocked at the edges to form a continuous skirt around the base of such buildings. These same panels may also be used to surround the insulated foundations of buildings where frigid winters are common. Often such panels are corrugated to provide increased strength.

2. Description of the Prior Art

In the past, skirting system distributors have encountered a problem in the high inventory required to maintain stocks of single color skirting panels. Because customers may desire any one of several different colors of panels, an excessive part of a distributor's warehouse space may be devoted to stocking each color of panel desired.

In addition, strong winds and varying ground contours have caused difficulty in maintaining the individual panels in place. Various interlock structures on prior skirting systems have been employed to resist such forces. One solution to this problem has been to insert retaining rods in the interlock formed at the edges of the panels, as shown in U.S. Pat. No. 4,400,919. This provides a satisfactory solution but increases the cost of both material and labor in installing such skirting.

SUMMARY OF THE INVENTION

The present invention endeavors to solve these problems by providing a unique interlock structure which is both strong and aesthetically pleasing when viewed from either side. The panels are provided with a different color on each side and may be embossed with a simulated woodgrain design on one or preferably both sides. Since each side may thus be provided with a different decorative appearance, the panel and thus the skirt is reversible to display the desired color and embossing. The provision of a different color on each side of a panel substantially reduces the warehouse inventory of the distributor. In order to provide a reversible panel, the invention employs cooperating overlaps and reverse bends at the edges of adjacent panels. By this construction, not only is a strong interlock formed which resists both pulling and pushing on the panels, but it permits an aesthetically pleasing appearance for the continuous skirt.

BRIEF DESCRIPTION OF THE DRAWINGS

FIG. 1 is a fragmentary, perspective view of a mobile home skirting assembly;

FIG. 2 is an enlarged fragmentary transverse cross-sectional view of the skirting assembly; and FIG. 3 is an enlarged, fragmentary top plan view of the panels with portions of the plate and retainer removed for clarity.

DESCRIPTION OF THE DRAWINGS

In the embodiment of my invention disclosed in FIGS. 1–3 there is provided a skirting assembly 10 for use in connection with an elevated building 12, such as a mobile home, the assembly 10 being in the nature of a continuous skirt which surrounds the building 12 and thereby encloses the space beneath the building.

The skirting assembly 10 is made up of a plurality of initially separate elongated panels 14 disposed in edge-to-edge relationship and spanning the distance between the upper surface of the ground 16 (FIG. 2) and the building 12, preferably in overlapping relationship to the latter.

Each of the upright, ground supported panels 14 is provided with means to present upright interlock structures broadly designated by the numeral 18, as best seen in FIG. 3 of the drawings. Hence a panel **14*a* has an overlap 20 extending throughout one of its upright edges, the overlap 20 continuing into a reverse bend 22, the latter terminating in a lip 24**.

On the other hand, the next adjacent panel **14*b* has an extension 26 which similarly terminates in a reverse bend 28 and a lip 30. The extension 26 and reverse bend 28 are retained between a retaining corrugation 32 and reverse bend 22. The interlock 18 is thereby hidden by the overlap 20 and the retaining corrugation 32 and presents an appearance similar to a conventional reinforcing corrugation 34**.

As may be readily appreciated from FIG. 3, extension 26 and corrugation 32 define an angle therebetween. Similarly, a second angle is defined by the corrugation 32 and a plane extending normal to the panels 14. The smallest angle between the extension 26 and the corrugation 32 is greater than the second angle between the corrugation 32 and the plane extending normal to the panels 14.

In FIG. 2 there is illustrated a mounting plate broadly designated by the numeral 36 which surrounds the building 12 and is attached thereto by a series of fasteners (not shown). The plate 36 is provided with a loop 38 having an inwardly facing hook 40 formed at the normally lowermost edge thereof.

A retainer 42 overlies the upper marginal portions of the panel 14 and the plate 36. Retainer 42 has bends 44 and 46 and a ledge 48 which combine to apply compression between the retainer 42 and spaced protuberances 50 on the plate 36.

The upper marginal portion of retainer 42 presents an outwardly facing hook 52 which has its free edge seated within inwardly facing hook 40 when the retainer 42 is in place, this seating engagement serving to secure retainer 42 with respect to plate 36.

A bottom rail 54 rests on the ground surface 16 and is anchored thereto by a plurality of stakes 56. Rail 54 is channeled upwardly to receive panels 14.

The interior face 58 and exterior face 60 of the panels 14 are provided with different color coatings, thereby reducing dealer inventory and permitting choice of color to be reserved until the time of installation. Separate colors may be provided through conventional means such as painting, or in the preferred embodiment, material is used to form the panels 14 through co-extrusion.

OPERATION

Installation of the skirting assembly 10 in association with the building 12 contemplates, at the outset, the attachment of the plate 36 to the outside of the building 12 adjacent its lower extremities through use of the fasteners (not shown).

Thereupon, a series of panels 14 may be joined together to form a continuous, building surrounding skirt assembly through use of the interlock structures 18. In this improvement of the interlock 18, no additional hardware or fasteners are required to ensure engagement of adjacent panels such as 14*a* and 14*b*.

The assembled skirt assembly 10 is placed in surrounding relationship to, and in engagement with the previously attached mounting plate 36. The panels 14 are associated with the bottom rail 54 and the latter is held in place through use of the stakes 56 such that the panels 14 are essentially vertical. Referring to FIGS. 2 and 3, the stakes 56 may be driven into the ground through predrilled holes 62 in the channel 64 and/or the tab 66 of the bottom rail 54.

The installation is completed by the attachment of the retainer 42 and, in this connection, it can be seen that the workmen need only slide the retainer 42 in place such that the outwardly facing hook 52 of the retainer 42 engages the inwardly facing hook 40 of the mounting plate 36 and is thereby held in place.

With panels 14 thus inserted, the bends 44 and 46 of the retainer 42 are flexed and apply corresponding pressure against the panel 14 to hold it in position against the protuberances 50 of the plate 36. The bottom rail 54 engages the lower edge of the panels 14 and maintains them in an essentially vertical position.

It can now be seen that as the contour of the ground surface 16 changes, rising, falling and buckling, thereby raising and lowering the bottom rail, the skirting assembly 10 and particularly all of its panels 14 move up and down within the retainer 42 between the latter and the plate 36. The protuberances 50, being within the path of the upward movement of the panels 14, serve to deflect the latter outwardly away from the building 12, thereby assuring freedom of panel movement, whether or not the panels tend to bow or warp, all because of the fact that the upper edges of the panels 14 slide easily and readily along the plate 36 without engaging or gouging the building 12 itself.

The arrangement of the interlock assembly 18 allows the panels 14 to expand and contract with weather changes. It further prevents a "blow out" of the panels 14 due to wind pressure thereon. For example, in FIG. 3, if panels 14a and 14b are pulled apart by lateral wind forces on the exterior panel face 60, the reverse bends 22 and 28 engage to prevent separation of the panels 14*a* and 14*b*. As a final restraining means, lips 24 and 30 engage a further limit separation.

As the interlock 18 is hidden and the panels are provided with different colors on each face 58 and 60, panels 14 may thereby be reversed upon installation so that face 58 would be on the exterior.

In the event of high winds, the extension 26 would be driven into the retaining corrugation 32, and further restrained by the reverse bends 22 and 28. Thus the effect of the interlock 18 is not only to restrain lateral movement of the panels 14 with respect to the plane of the building 12, and excessive linear movement of the panels 14 along the plane of the building 12 without additional fasteners, but further provides an aesthetically pleasing closure when viewing either face 58 or 60 of the panels 14.

Stakes 56 may be driven into the precut holes 62 in either the channel 64 of the bottom rail 54 or in the tab 66 of the bottom rail 54; or both, in areas where wind or other environmental conditions require additional reinforcement. Those holes 62 in the channel 64 not used for anchoring are useful for drainage of accumulated water.

When the skirting assembly 10 is employed to surround an insulated foundation of a building 12, the skirting assembly 10 is employed as described above but the ground 16 is regraded around the exterior face 60 of the panels 14 to the desired level after installation.

I claim:

1. In an elevated building having a space therebeneath, a skirt for said space comprising:

a plurality of upright, corrugated ground supported panels disposed in edge-to-edge substantially coplanar relationship, each panel presenting a first and a second side and planar panel portions, at least certain of the planar panel portions of each of said panels being substantially coplanar with each other, upper retaining means attached to said building and adapted to receive said panels therein;

interlock structure on adjacent vertical margins of said panels for maintaining the coplanar relationship therebetween, said interlock structure including a retaining corrugation wall, an overlap wall and a first reverse bend wall defining a vertical margin of one panel, said corrugation wall and overlap wall being obliquely oriented relative to the planar panel portions of the one panel and converging towards each other to cooperatively define therebetween a concave region, said reverse bend wall remote from said corrugation wall towards the corrugation wall and lying within said concave region, said reverse bend wall and and said extension wall presenting a first U-shaped interlock, an extension wall and a second reverse bend wall defining a vertical margin of another of said panels interconnected with said one panel, said extension wall and second reverse bend wall being obliquely oriented relative to the planar panel portions of said other panel and lying within said concave region, said second reverse bend wall extending from the edge of said extension wall remote from the planar panel portions of the other panel and towards the latter to present a second U-shaped interlock, said first and second U-shaped interlocks being interfitted within said concave region with said first and second reverse bend walls being substantially parallel, the smallest angle between said extension wall and said corrugation wall being greater than the angle between the corrugation wall and a plane normal to said planar panel portions whereby movement of said second U-shaped interlock in a direction toward said one panel is inhibited by said corrugation wall on the one panel.

2. The invention of claim 1; the reverse bend of each of the panels terminating in a lip angled toward the corresponding reverse bend of the adjacent panel.

3. The invention of claim 1 wherein said first side and the second side of each of the panels are of differing colors.

4. The invention of claim 1 wherein said lower retaining means is in the form of a rail presenting a channel for receiving the panels, there being a plurality of holes formed in the ground engaging surface of said rail.

* * * * *